United States Patent [19]

Wilkinson

[11] Patent Number: 4,889,469

[45] Date of Patent: Dec. 26, 1989

[54] A NOZZLE GUIDE VANE STRUCTURE FOR A GAS TURBINE ENGINE

[75] Inventor: Wilfred H. Wilkinson, Turnditch, United Kingdom

[73] Assignee: Rolls-Royce (1971) Limited, London, England

[21] Appl. No.: 929,557

[22] Filed: Jul. 28, 1978

Related U.S. Application Data

[63] Continuation of Ser. No. 688,097, May 24, 1976, abandoned.

[51] Int. Cl.[4] ..... F03B 3/18

[52] U.S. Cl. ..... 415/191; 415/115; 415/116; 415/137

[58] Field of Search ..... 60/39.32, 39.66; 415/115, 116, 135, 136, 137, 191

[56] References Cited

U.S. PATENT DOCUMENTS

| | | | |
|---|---|---|---|
| 2,833,514 | 5/1958 | Rainbow et al. | 415/115 |
| 3,300,178 | 1/1967 | Rizk et al. | 415/115 |
| 3,511,577 | 5/1970 | Karstensen | 415/115 |
| 3,558,237 | 1/1971 | Wall, Jr. | 415/115 |
| 3,703,808 | 11/1972 | Stearns | 415/115 |
| 3,832,090 | 8/1974 | Matto | 415/115 |
| 3,966,353 | 6/1976 | Booher, Jr. et al. | 415/115 |
| 3,966,354 | 6/1976 | Patterson | 60/39.32 |

FOREIGN PATENT DOCUMENTS

| | | | |
|---|---|---|---|
| 1942346 | 3/1971 | Fed. Rep. of Germany | 415/115 |

*Primary Examiner*—Stephen C. Bentley
*Attorney, Agent, or Firm*—Cushman, Darby & Cushman

[57] ABSTRACT

A nozzle guide vane structure for a gas turbine engine in which the vane comprises an aerofoil portion and inner and outer platforms. The non gas-contacting surfaces of the platforms are provided with forward and rearward sealing flanges sealed to adjacent engine structure to provide spaces sealed against ingress of working fluid between each pair of forward and rearward flanges. The mounting means for the vane projects into these spaces from the non gas-contacting surface.

6 Claims, 1 Drawing Sheet

A NOZZLE GUIDE VANE STRUCTURE FOR A GAS TURBINE ENGINE

This is a continuation, of application Ser. No. 668,097, filed May 24, 1976, now abandoned.

This invention relates to a nozzle guide vane structure for a gas turbine engine.

The nozzle guide vanes of gas turbine engines which are used to direct hot gases flowing from the combustion chamber have always posed problems in providing mounting structures which can withstand the various loads and be resistant to the adverse conditions surrounding the vane. Thus it has been the practice to mount these vanes from flanges which extend from the vane platforms, the flanges also acting as sealing means to prevent leakage of hot gases. However these prior art proposals have suffered because in order to combine the conflicting requirements of producing an annular sealing flange and providing a fairly massive load carrying structure, the resulting construction has been rather more heavy than is necessary.

The present invention provides a nozzle guide vane structure which is of relatively light weight.

According to the present invention a nozzle guide vane structure for a gas turbine engine comprises an aerofoil portion having inner and outer platform members which define the inner and outer boundaries of the annulus of hot gas passing through the vane structure, each platform having a forward and a rearward sealing flange extending from that surface away from the hot gas flow adjacent the forward and rearward edges respectively of the platform, said flanges being sealed to adjacent structure of the engine so as to provide a space between each forward and rearward flange sealed against ingress of hot gases, and mounting means for the vane projecting from said surface of each platform intermediate the forward and rearward flanges and into the sealed space.

Preferably there is a cooling air supply to each of the sealed spaces which is arranged to be at the same temperature.

The mounting means preferably comprises dogs which extend from the aerofoil portion through the platforms to engage with fixed mounting structure of the engine.

The forward sealing flanges may seal against the downstream extremity of the combustion chamber of the engine, while the downstream flanges are sealed to other fixed structure.

The rearward sealing flanges are preferably sealed to the fixed structure by way of resilient sealing devices such as annular springs. In one instance the annular spring is of part circular section, one edge and the centre of the section being retained to fixed structure while the other edge acts as the sealing portion.

Figure 1:
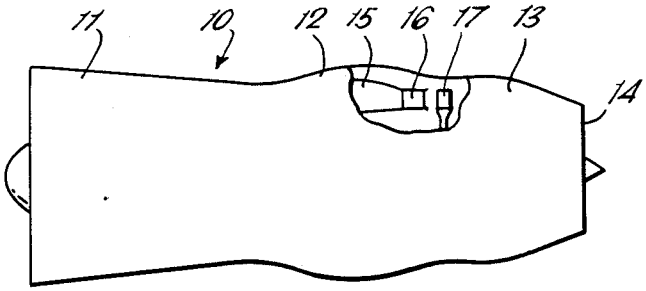
Figure 2:
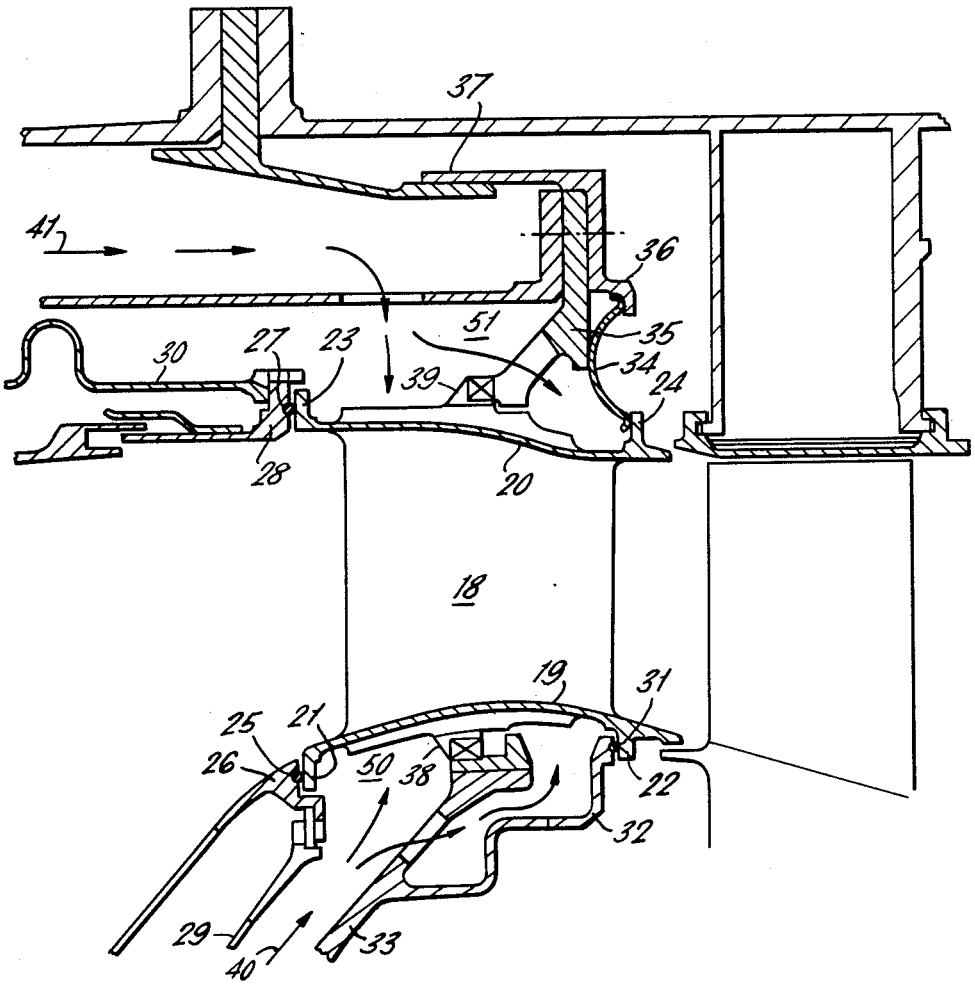

The invention will now be particularly described, merely by way of example, with reference to the accompanying drawings in which:

FIG. 1 is a partly broken-away view of a gas turbine engine having nozzle guide vane structure in accordance with the invention, and FIG. 2 is an enlarged sectional view of the nozzle guide vane structure of FIG. 1.

In FIG. 1 there is shown a gas turbine engine 10 having a compressor section 11, a combustion section 12, a turbine section 13 and a final nozzle 14. The gas turbine operates in a conventional manner in that the compressor 11 takes in air which it compresses before it is passed to the combustion section 12. In the combustion section the air is mixed with fuel and burnt, the resulting hot gases serving to drive the turbine in the turbine section 13. The turbine and the compressor are drivingly interconnected so that the turbine in turn drives the compressor. The hot gases from the turbine then pass through the nozzle 14 to provide propulsive thrust.

The casing of the engine is broken away in the region of the transition between the combustion section 12 and the turbine section 13, and through the broken away casing there are visible the combustion chamber 15, nozzle guide vanes 16 and high pressure turbine rotor 17. The nozzle guide vanes 16 serve to direct the hot gases from the combustion chamber 15 onto the turbine rotor 17, and they are consequently subject to very high temperatures and considerable gas loads. FIG. 2 shows in more detail the structure in accordance with the invention which enables the vanes to be mounted.

In FIG. 2 it will be seen that the vanes 16 comprise aerofoil portions 18 which comprise the main gas directing structures, and inner and outer platforms 19 and 20 which define the inner and outer boundaries of the hot gas flow. The platforms 19 and 20 are each provided with forward and rearward sealing flanges 21 and 22 and 23 and 24 respectively. Each of these flanges extends circumferentially with respect to the annular array of vanes and abuts against adjacent flanges to provide a fully annular sealing flange.

The flanges 21 and 23 are both mounted at the extreme forward edges of the inner and outer platforms, and they each seal against the rearwardly facing extremity of the downstream end of the combustion chamber 15; thus in the case of the inner flange 21 a seal is made by way of a sealing wire 25 against an annular thickened portion 26 of the inner wall of the combustion chamber, while the outer flange 23 seals by way of a sealing wire 27 against a thickened portion 28 at the downstream extremity of the outer wall of the combustion chamber.

There is also provided inside the combustion chamber a casing portion 29 which is attached to the thickened chamber portion 26, so that the casing member 29, the thickened portion 26 and the flange 21 co-act to prevent the hot gases flowing into the space bounded by the casing 29 and the platform 19.

Similarly a casing member 30 extends round the outside of the combustion chamber and is attached to the thickened portion 28. Once again these three members prevent hot gases from the combustion chamber flowing into the space bounded by the casing 30 and the platform 20.

The inside flange 22 is sealed to fixed structure of the engine. In this case the upstream face of the flange 22 seals through a sealing wire 31 against a resilient annular projection 32 which is carried from a frustoconical mounting flange 33. It will thus be seen that sealing of the various structures against the internal flanges is effected by resilient pressure from the combustion chamber pressing the wire 25 against the flange 22 and resilient pressure from the member 32 pressing the wire 31 against the flange 23. The member 32 is unapertured and therefore a chamber 50 is formed between the members 29 and 32 and the platform 19 which is completely sealed from the working fluid of the engine in the area of the vanes.

In the case of the flange 24 an annular spring 34 is provided which abuts against the upstream face of the flange. The spring 34 is substantially part circular in cross-section, and the edge of the section abuts against the flange. The centre of the section is held abutting against a mounting flange 35 while the other edge is trapped abutting under a projection 36. It will therefore be seen that by arranging the dimensions of the structure it is possible to nip the spring 34 between its three abutments to provide sealing engagement. The mounting flange 35 and the projection 36 are supported by a sleeve 37 from the casing of the engine, and in a similar manner to the construction at the inside of the guide vanes the sleeve 37, the spring 34, the platform 20 and the casing 30 provide a chamber 51 sealed against ingress of the local working fluid.

In order to support the guide vanes against the gas loads and the resilient sealing loads on the sealing flanges, dogs 38 and 39 project from the inside and outside respectively of the extremities of the aerofoil section 18 through the respective one of platforms 19 and 20 (this structure is more fully described and claimed in the co-pending U.S. application Ser. No. 662,170, filed Feb. 27, 1976). The dogs 38 and 39 engage with corresponding features on the mounting flanges 33 and 35 and transmit loads from the aerofoils directly into these flanges. It will be noted that both these mounting arrangements are intermediate the respective pair of flanges and are consequently inside the sealed chambers 50 and 51 referred to above.

The mounting arrangements of the vanes are thus completely separated from the local hot working fluid, and to ensure that these are both maintained at the same relatively low temperature, cooling air is fed into both sealed chambers. In the case of the inner chamber, cooling air, as indicated by the arrows 40 is allowed to flow between the casing 29 and mounting flange 33 to fill the inner sealed cavity. It would normally be convenient to use this cavity as a source of cooling air for the aerofoil section 18 in one of the various available cooling configurations.

Similarly cooling air as shown by the arrows 41 is fed to the outer chamber between the casing 30 and sleeve 37; this air may also be used for vane cooling purposes. Although there is no source indicated for the cooling air it will be appreciated that in most cases this air would be bleed air from the compressor of the engine, but of course it would be possible to provide a completely separate source.

It will be understood that by arranging that the cooling air at the inside and the outside of the vane structure is at the same temperature, the mounting arrangements will both be at the same temperature. This is very valuable since in this manner thermal fight between the two sets of mountings may be substantially avoided. However, it will also be understood that even if the cooling air temperatures differ, they still provide means for providing a stable temperature for the mounting arrangement which can be considerably less than that of the hot gas stream.

It would be noted that a number of variations would be possible in the structure described. Thus a variety of other sealing means could be used to seal the platforms to structure of the engine and the vane mounting arrangements could take a variety of different forms.

I claim:

1. A nozzle guide vane structure for a gas turbine engine comprising an aerofoil portion having integral inner and outer platform members, each platform member having a gas contacting surface which defines part of the boundary of the annulus of hot gas which passes, in operation, through the vane structure and a nongas contacting surface from which extends a forward and a rearward sealing flange, the flanges being adjacent the forward and rearward edges respectively on the platform, sealing means including at least one resilient sealing device between adjacent structure of the engine and the flanges, said sealing means providing a space between each forward and rearward flange sealed against ingress of the hot gases, and mounting means for the vane structure including dogs extending from the aerofoil portion through each platform and projecting from the nongas contacting surface of each platform intermediate the forward and rearward flanges off the same and into the sealed space, said dogs being connected in each sealed space to adjacent fixed mounting structure of the engine so as to support the vane structure against axial and radial movement and so as to transfer all gas loads on said aerofoil portion of the vane structure directly to the adjacent fixed mounting structure of the engine without the loads going through the flanges of said platforms whereby said flanges and said platforms are of a relatively light weight construction.

2. A nozzle guide vane structure as claimed in claim 1 comprising means for supplying cooling air to each of said sealed spaces.

3. A nozzle guide vane structure as claimed in claim 2 and in which the supply of cooling air to each of the sealed spaces is arranged to be at the same temperature.

4. A nozzle guide vane structure as claimed in claim 1 and in which said resilient sealing device comprises an annular spring of part circular section, one edge and the centre portion of the section abutting against fixed structure while the other edge seals against the respective sealing flange.

5. A nozzle guide vane structure as claimed in claim 1 and comprising a sealing wire by way of which at least one said sealing flange seals against its respective structure.

6. A nozzle guide vane structure as claimed in claim 1 and in which the combustion chamber of the engine has a downstream extremity which seal against said forward sealing flanges.

* * * * *